US006120388A

United States Patent [19]

Blough et al.

[11] Patent Number: 6,120,388

[45] **Date of Patent: *Sep. 19, 2000**

[54] PERIMETER WEIGHTED IRON TYPE GOLF CLUB HEAD WITH MULTIPLE LEVEL WEIGHT PADS

[75] Inventors: Robert Thomas Blough, Mineral; Ronie Foy McGraw, Glen Allen, both of Va.; Donald Steven Rahrig, Arlington, Tex.

[73] Assignee: Spalding Sports Worldwide, Inc., Chicopee, Mass.

[ * ] Notice: This patent is subject to a terminal disclaimer.

[21] Appl. No.: 09/299,949

[22] Filed: Apr. 26, 1999

Related U.S. Application Data

[62] Division of application No. 08/852,701, May 27, 1997, Pat. No. 5,921,869.

[51] Int. Cl.[7] ..... A63B 53/04

[52] U.S. Cl. ..... 473/291; 473/350

[58] Field of Search ..... 473/349, 350, 473/334–339, 290–292

[56] References Cited

U.S. PATENT DOCUMENTS

| | | | |
|---|---|---|---|
| 5,026,056 | 6/1991 | McNally et al. | 473/350 |
| 5,160,136 | 11/1992 | Eger | 473/291 |
| 5,921,869 | 7/1999 | Blough et al. | 473/291 |

*Primary Examiner*—Mark S. Graham

[57] ABSTRACT

A golf club head set having the club head back side divided into four areas, including the perimeter weighted region A; the sweet spot area B located directly behind the ball, two non-striking areas C, and the low central region D. The sweet spot area is further divided into three distinct weight levels, and the low central region has been divided into four additional weight levels. By adding and drooping weight levels as well as by changing the thickness of the levels, the weight distribution of each club head is changed to control center of gravity and polar movement of inertia and provide gradated performance specific to each club head.

2 Claims, 4 Drawing Sheets

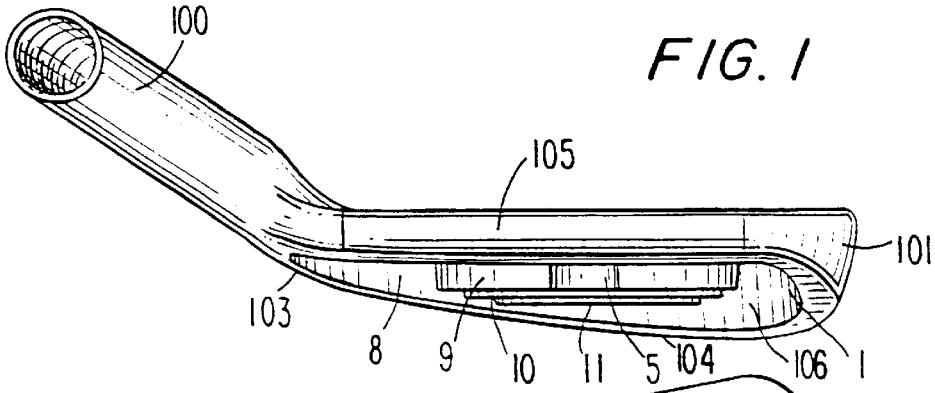
FIG. 1
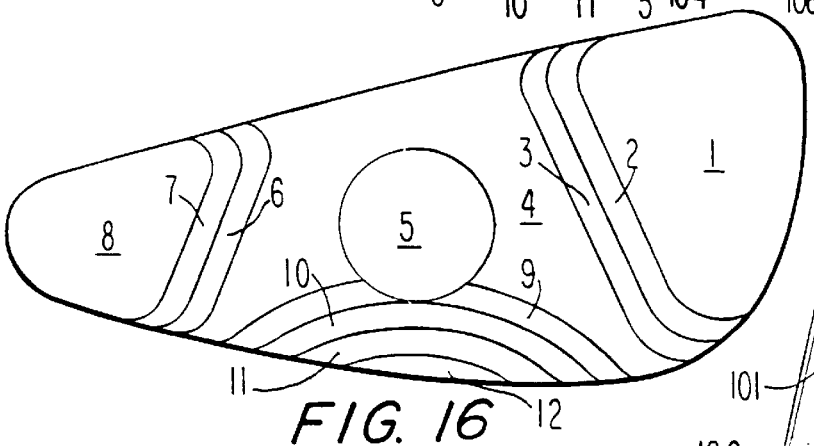
FIG. 16
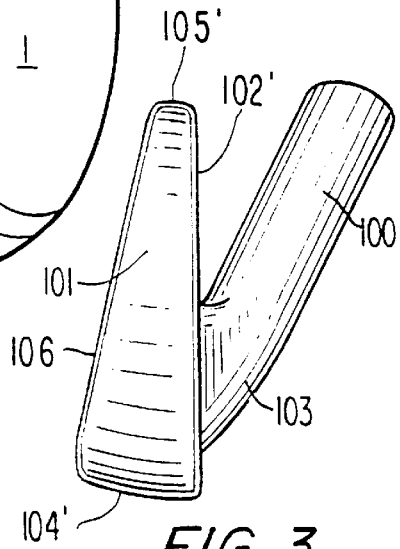
FIG. 3
FIG. 2
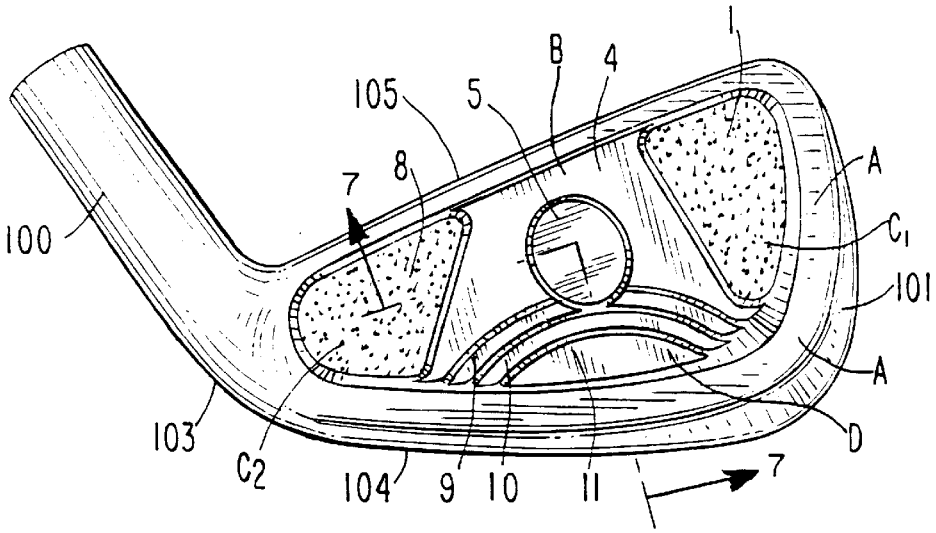

FIG. 4
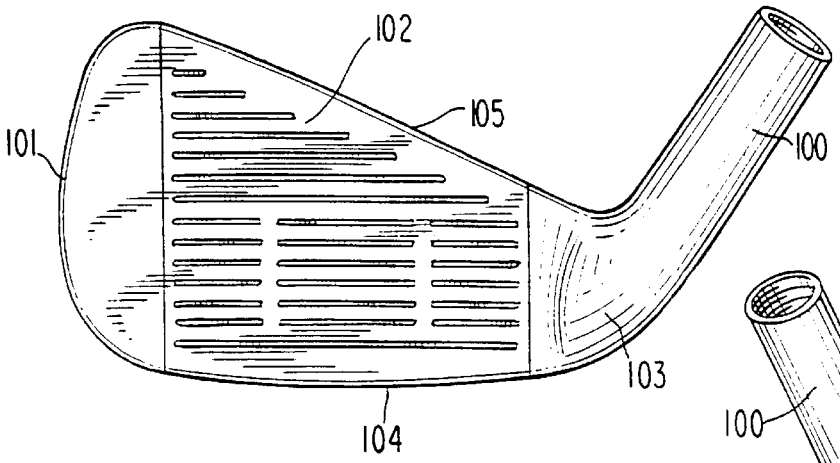
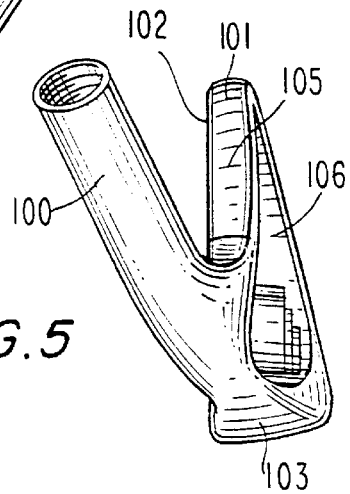
FIG. 5
FIG. 6
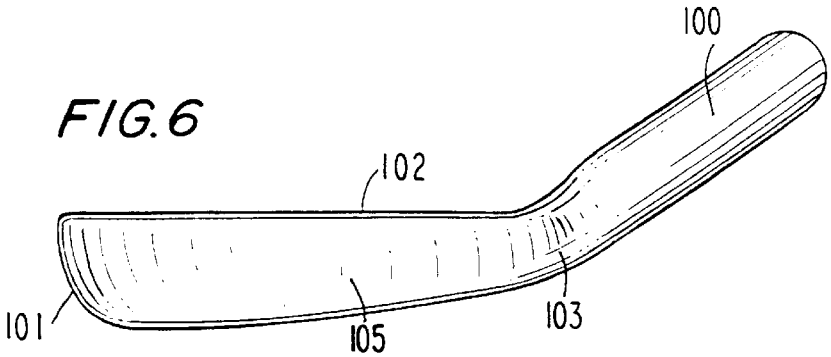
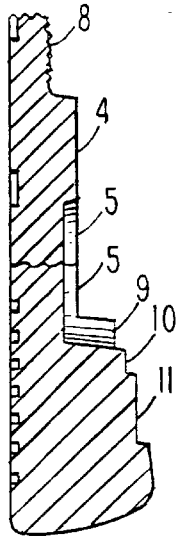
FIG. 7

FIG. 8
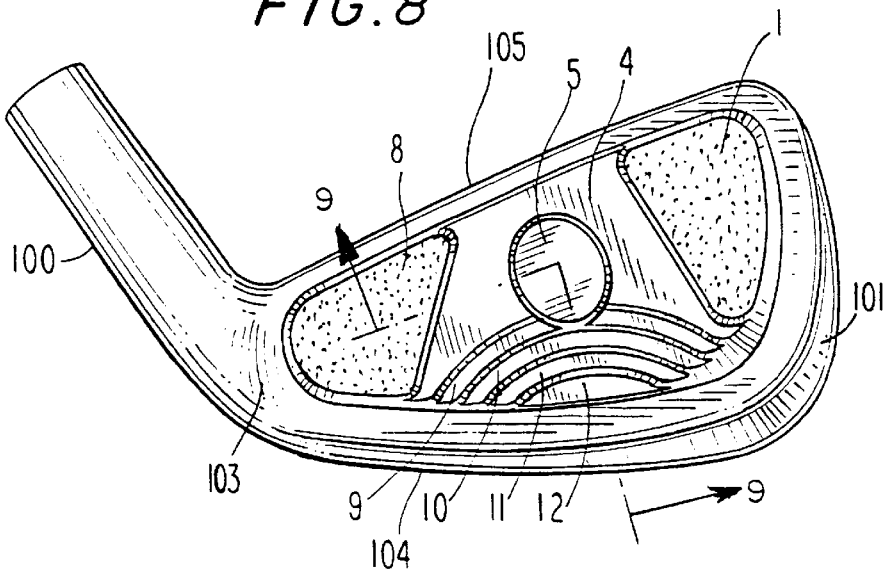
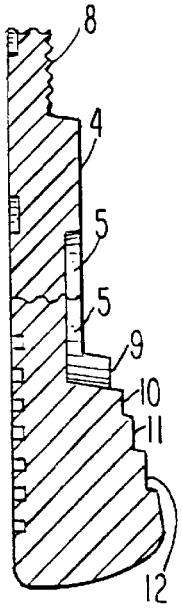
FIG. 9
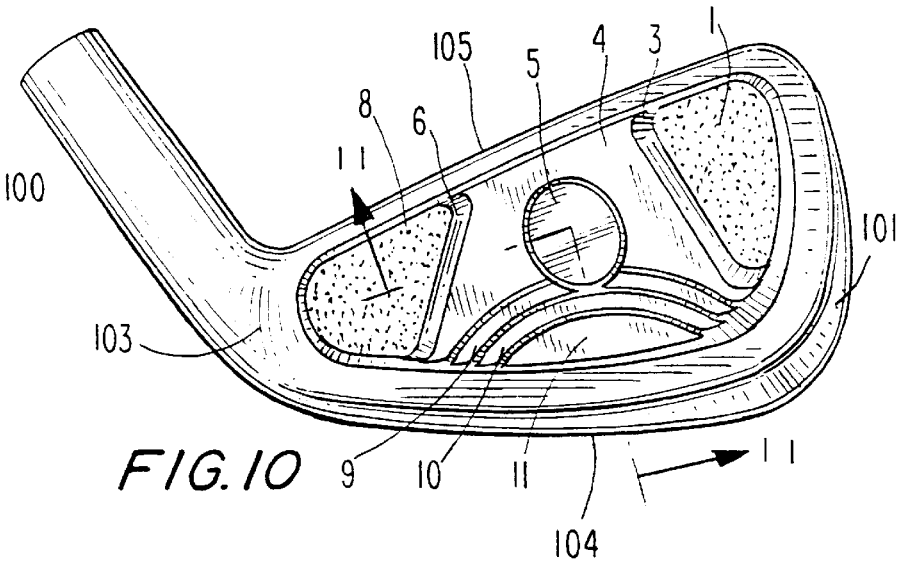
FIG. 10
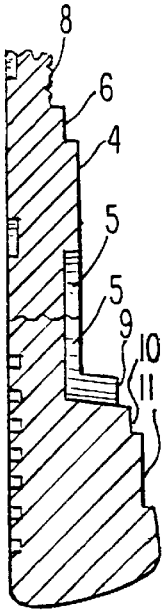
FIG. 11

FIG. 12
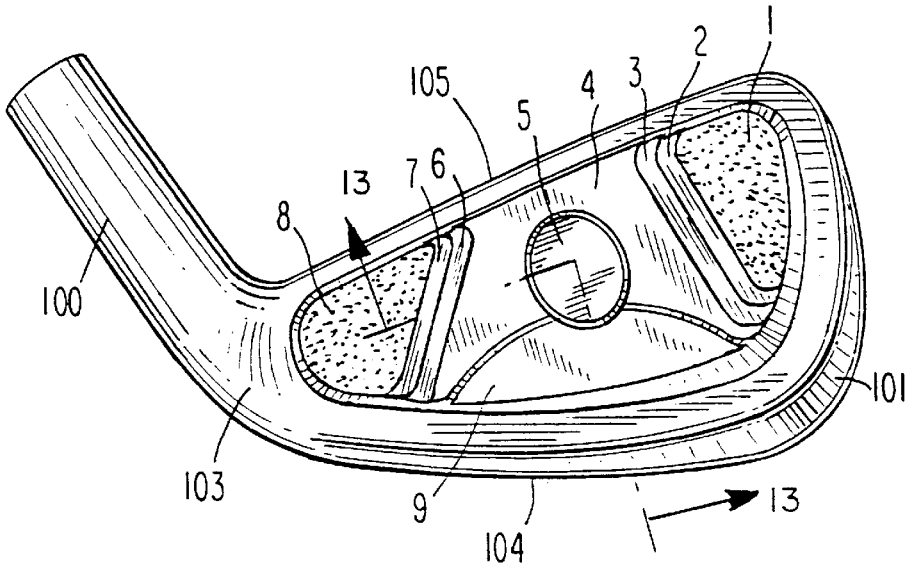
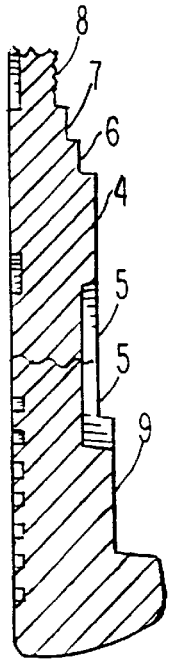
FIG. 13
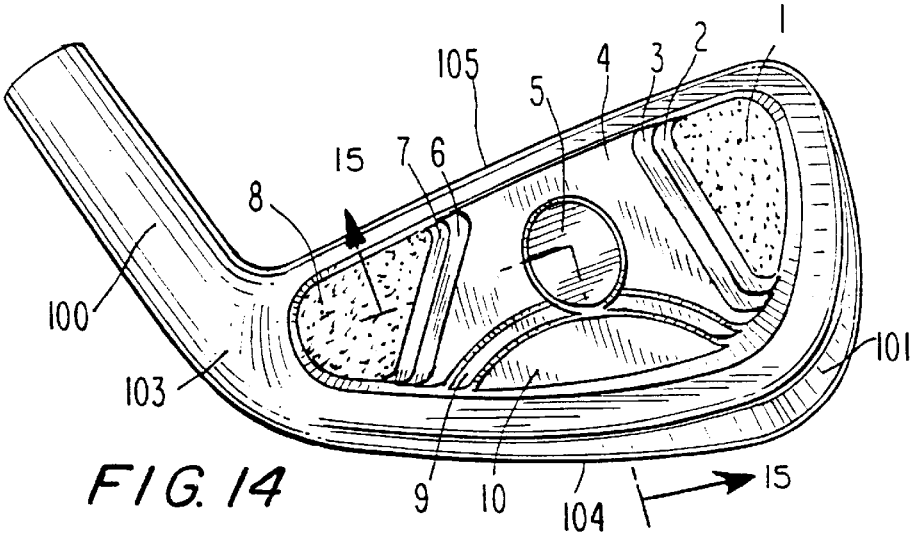
FIG. 14
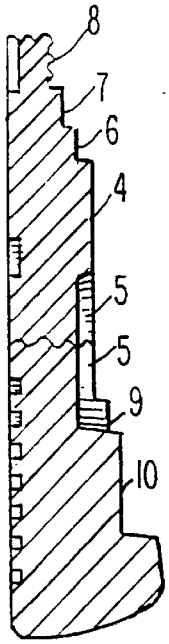
FIG. 15

PERIMETER WEIGHTED IRON TYPE GOLF CLUB HEAD WITH MULTIPLE LEVEL WEIGHT PADS

This is a divisional of U.S. application Ser. No. 08/852,701 filed on May 27, 1997 U.S. Pat. No. 5,921,869.

BACKGROUND OF INVENTION

1. Field of Invention

This invention relates to perimeter weighted iron type golf club heads, and more particularly, to perimeter weighted iron type golf club heads having a rear cavity containing a gradated secondary weight system.

2. Description of the Prior Art

It has been common practice in recent years to provide iron type golf club heads with perimeter weighting by forming a cavity on the back side of the club head. Distributing the major portion of the club head weight around the perimeter of the club head results in a lower center of gravity and increased polar moment of inertia (PMI) for the club. The lower center of gravity has the effect of increasing the trajectory of the resultant ball flight and making the lower lofted irons easier to hit. The increased polar moment of inertia causes the club head to resist twisting at the moment of impact with a ball during an off center hit, resulting in a more forgiving club. This feature has been a boon to encouraging newer players to participate in the sport.

Unfortunately, lowering the center of gravity also increases the ball trajectory for the higher lofted clubs. This increased altitude causes the ball to be more susceptible to effects of the wind, and a subsequent loss in precision for golf players. The increased polar moment of inertia makes it harder for the better player to "work" the ball advantageously in his short game. It also has the undesirable effect of reducing the club head "sweet spot", which in turn reduces the amount of positive feedback the player receives. In general, expertly and poorly struck balls feel the same to the player. This lack of differentiation deprives the player of information needed to continue to improve his game skill.

In order to overcome the basic disadvantages of perimeter weighted golf clubs, many attempts have been made to improve the weight distribution by including in the rear cavity formed by the perimeter weighting some type of auxiliary weighting of various structural forms. Pertinent examples of this type of golf club head are disclosed in U.S. Pat. Nos. 4,826,172; 4,907,806; 4,919,430; 5,014,993; 5,048,834; 5,242,167; 5,328,184 and 5,395,113 to Antonious, and U.S. Pat. No. 5,333,872 to Manning et al;. Also, U.S. Design Pat. Nos. 328,322 and 363,332 show similar perimeter weighted golf club head designs.

The present invention enhances the positive aspects while reducing undesirable side effects of perimeter weighted iron type golf club heads with a back cavity and additional gradated weight members provided within the cavity.

SUMMARY OF INVENTION

The object of the present invention is to provide a set of perimeter weighted iron type golf club heads which includes highly perimeter weighted long irons with expanded sweet spots for the shorter irons. This improved result is accomplished through a unique system of gradated weight pads provided in the rear cavities formed by the perimeter weighting of the club head.

The back side of the club head body is divided into four regions, including the perimeter weighted region A, the sweet spot region B located directly behind the wall striking area, two non-striking regions C located at each end of the club head, and the low central region D. The sweet spot region B is further divided into three distinct weighted levels, and the low central region D has been divided into four additional weighted levels. By adding and dropping weight levels as well as by changing the thickness of the different levels, the weight distribution of each club head in the set is changed so as to tailor improved gradated performance specific to each club in the set.

BRIEF DESCRIPTION OF THE DRAWINGS

This invention will be described further with reference to the following drawings, in which:

FIG. 1 is a perspective view of the top of one embodiment of a club head according to the present invention, showing different levels of the weighted pads on the club back side;

FIG. 2 is a perspective view of the back side of the club head embodiment of FIG. 1;

FIG. 3 is a perspective view of the toe end of the club head embodiment of FIG. 1;

FIG. 4 is a perspective view of the front surface of the club head embodiment of FIG. 1;

FIG. 5 is a perspective view of the heel portion of the club head embodiment of FIG. 1;

FIG. 6 is a perspective view of the top of the club head embodiment of FIG. 1;

FIG. 7 is a sectional view taken along line 7—7 of FIG. 2;

FIG. 8 is a perspective view of the back side of a second embodiment of the club head according the present invention;

FIG. 9 is a sectional view taken along line 9—9 of FIG. 8;

FIG. 10 is a perspective view of the back side of a third embodiment of the club head according to the present invention;

FIG. 11 is a sectional view taken along line 11—11 of FIG. 10;

FIG. 12 is a perspective view of the back side of a fourth embodiment of the club head according to the present invention;

FIG. 13 is a sectional view taken along line 13—13 of FIG. 12;

FIG. 14 is a perspective view of the back side of a fifth embodiment according the present invention;

FIG. 15 is a section view taken along line 15—15 of FIG. 14; and

FIG. 16 is an outline of the various reasons of the ream cavity area of the set of club heads numbered sequentially from the toe to the heel of the club head according to the invention.

DESCRIPTION OF PREFERRED EMBODIMENTS

As shown in the FIGS. 1–6, 8, 10, 12 and 14 drawings, all of the club heads in the set include a hosel 100, a toe portion 101, a front portion 102, a heel portion 103, a bottom portion 104, and a top portion 105. The club head also includes a front striking face on front portion 102 and a back cavity 106 which includes the sweet spot area and weight pad levels 1, 4, 5, 8 and 9 and optional weight pad levels 2, 3, 6, 7, and 10–2 as shown by FIG. 16.

As generally indicated in FIG. 2, the golf club head back side is divided in four regions including the outer perimeter weighted region A, the central "sweet-spot" region B, the two non-striking regions $C_1$ and $C_2$ located near the toe and heel ends of the club head, respectively, and the lower central region D. The number, thickness and area of each weight pad area or level is varied so as to sequentially raise the center of gravity of the club head, increase the sweet spot area and reduce the polar moment of inertia. The weight pad level 5 is recessed relative to its surrounding area 4.

For the set of 14 gradated club heads according to the present invention, the areas of the various numbered weight pad levels are listed in Table 1 below, with the numbered areas 1–12 being given in square centimeter ($CM^2$) units.

TABLE 1

| Area Weight Level | CLUB HEAD DESIGNATION 1 | 2 | 3 | 4 | 5 | 6 |
|---|---|---|---|---|---|---|
| 1 | 6.725 | 7.311 | 7.285 | 6.401 | 6.710 | 5.751 |
| 2 | N/A | N/A | N/A | N/A | N/A | N/A |
| 3 | N/A | N/A | N/A | N/A | N/A | 1.169 |
| 4 | 5.500 | 5.660 | 5.594 | 5.742 | 5.761 | 5.761 |
| 5 | 1.769 | 1.769 | 1.769 | 1.769 | 1.769 | 1.769 |
| 6 | N/A | N/A | N/A | N/A | N/A | 0.767 |
| 7 | N/A | N/A | N/A | N/A | N/A | N/A |
| 8 | 3.617 | 3.684 | 3.407 | 3.942 | 3.994 | 2.953 |
| 9 | 0.939 | 1.015 | 0.982 | 1.088 | 1.131 | 1.109 |
| 10 | 0.764 | 0.947 | 0.800 | 1.011 | 1.056 | 1.028 |
| 11 | 0.538 | 0.653 | 0.570 | 1.075 | 1.253 | 1.095 |
| 12 | 0.212 | 0.237 | 0.253 | N/A | N/A | N/A |

Note:
N/A means not applicable

| Level | CLUB HEAD DESIGNATION 7 | 8 | 9 | P | F | S | L | H |
|---|---|---|---|---|---|---|---|---|
| 1 | 5.275 | 5.213 | 5.322 | 4.125 | 4.146 | 3.713 | 3.947 | 3.257 |
| 2 | N/A | N/A | N/A | 1.215 | 1.030 | 1.115 | 0.902 | 1.127 |
| 3 | 1.182 | 1.175 | 1.126 | 1.163 | 1.031 | 1.092 | 0.911 | 1.143 |
| 4 | 5.791 | 5.921 | 5.793 | 5.830 | 5.368 | 5.609 | 4.954 | 4.928 |
| 5 | 1.769 | 1.769 | 1.769 | 1.769 | 1.769 | 1.769 | 1.769 | 1.769 |
| 6 | 0.789 | 0.790 | 0.788 | 0.716 | 0.626 | 0.719 | 0.603 | 0.637 |
| 7 | N/A | N/A | N/A | 0.780 | 0.677 | 0.720 | 0.656 | 0.707 |
| 8 | 3.226 | 2.793 | 2.886 | 2.050 | 1.825 | 2.107 | 1.829 | 1.629 |
| 9 | 1.103 | 1.198 | 1.150 | 1.154 | 0.878 | 3.132 | 1.357 | 1.369 |
| 10 | 1.037 | 2.779 | 2.375 | 2.523 | 1.139 | N/A | N/A | N/A |
| 11 | 1.153 | N/A | N/A | N/A | N/A | N/A | N/A | N/A |
| 12 | N/A | N/A | N/A | N/A | N/A | N/A | N/A | N/A |

In the long irons, for club heads designated Nos. 1–3, there is one weight pad level 4 provided in the sweet spot region B and all four weight pad levels 9–12 are provided in low central region D, as shown in FIG. 8. The weight pad level 4 in region B provides the club head with a well defined sweet spot region B. The central weight pad levels 9–2 in the region D concentrate the remaining weight down below the center of the sweet spot for a golf ball, enhancing the club's ability to get the ball airborne after hitting it.

In club heads Nos. 4 and 5, the weight is moved higher and is more evenly distributed. This is accomplished by dropping the lowest weight pad level 12 relative to the ground, and dividing its weight into the non-striking areas 1 and 8 as shown in FIG. 2. The increase in weight of areas 1 and 8 and the related increase in thickness of these areas moves the center of gravity slightly upward towards the ball impact zone, increases the sweet spot area, and reduces the polar moment of inertia for the club head.

Club heads Nos. 6 and 7 have additional weight pad levels in areas 3 and 6 in the central region D as shown in FIG. 10. This configuration further raises the center of gravity and widens the sweet spot, which has the further effect of reducing the polar moment of inertia and enhancing the player's ability of "working the ball" advantage.

In club heads Nos. 8 and 9, the center of gravity is raised even further and the workability is increased by removing weight pad level 11 in the low region and redistributing the weight to non-striking areas 1 and 8. The Pitching Iron P and Fairway Wedge F continue the trend by the addition of weight pad levels 2 and 7 in the central region, as shown in FIG. 14.

Finally, the Lob Wedge L and High Wedges H complete the transition from highly perimeter weighted/low center of gravity club irons to a club having more moderate weight distribution with a large area sweet spot. Removing weight pad level 10 from the low weight area leaving only the highest and widest level 9 in that area as in FIG. 12 provides the greatest "feel" for the club to the player.

Gradually reducing the polar moment of inertia of the club heads as they progress through the set creates long irons with greater torsional rigidity at impact with the ball so as to provide improved forgiveness for off-center hits. The shorter irons with the reduced polar moment or inertia and therefore reduced torsional rigidity, allow the player to hit open or closed face shots with much greater control than previously possible in a set of game improvement irons.

Manipulating the club head center of gravity locations creates an impulse vector that has an upward directed vertical component in the long irons increasing the club's ability for getting the ball airborne. Club irons with large lofts provide no problem in getting the ball airborne and, in fact, extremely high ball trajectories can adversely affect hitting accuracy for these irons. This tendency for high ball trajectories is reduced with higher centers of gravity for the club head, and therefore smaller vertical components of the impulse vector.

Although this invention has been described broadly and also in terms of preferred embodiments, it is understood that variations may be made in the structure of the golf club heads as described above without departing from the nature of the invention as defined in the claims.

I claim:

1. A golf club set comprising a plurality of perimeter weighted iron type golf club heads, each of said heads comprising:

(a) a hosel having an upper and lower end;

(b) a club head body having a toe end and a heel end, said club head body being attached at its heel end to the lower end of said hosel, said club head body having a center of gravity and a polar moment of inertia, and further comprising a substantially planar front striking face, a back side located opposite said front striking face, and characterized by having an outer perimeter weighted region A, forming a cavity 106 containing a central sweet spot region B, and a central low region D; and (c) gradated area weight pad levels within said cavity for sequentially raising the center of gravity of the club head body and increasing the central sweet-spot area for each successive increased club head designation number in the golf club set, the number and thickness of said area weight pad levels being varied so as to reduce the polar moment of inertia for each successive increased club head designation number in the golf club set.

2. A golf club set as defined in claim 1, wherein said area weight pad levels further vary in size.

* * * * *